US007780026B1

(12) United States Patent
Zuckerman

(10) Patent No.: US 7,780,026 B1
(45) Date of Patent: Aug. 24, 2010

(54) BAND-FREE CONTAINER PACKAGING

(75) Inventor: Edward S. Zuckerman, Denville, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 560 days.

(21) Appl. No.: 11/689,695

(22) Filed: Mar. 22, 2007

(51) Int. Cl.
*A47G 19/00* (2006.01)
*B65D 21/02* (2006.01)
*B65D 85/62* (2006.01)

(52) U.S. Cl. ..... 220/23.4; 206/504; 206/508; 206/509; 220/23.6

(58) Field of Classification Search ..... 89/34; 206/1.5, 3, 504, 508–510, 821, 503, 511, 206/512; 220/23.2–23.8, 380, 23.83, 674, 220/756; 249/126
See application file for complete search history.

(56) References Cited

U.S. PATENT DOCUMENTS 2,705,575 A * 4/1955 Hammer ..... 220/849
3,346,137 A * 10/1967 Ricci ..... 220/23.6
4,293,072 A * 10/1981 Hill et al. ..... 206/512
5,628,443 A * 5/1997 Deutsch ..... 224/583
5,704,625 A * 1/1998 Presnell et al. ..... 280/79.2
6,840,378 B2 * 1/2005 Toguchi ..... 206/503
2004/0000550 A1 * 1/2004 Taccolini et al. ..... 220/23.4

FOREIGN PATENT DOCUMENTS

GB 2056412 A * 3/1981

* cited by examiner

*Primary Examiner*—Anthony Stashick
*Assistant Examiner*—Brett Edwards
(74) *Attorney, Agent, or Firm*—John F. Moran

(57) ABSTRACT

A stackable container includes top and bottom surfaces; opposing side surfaces; opposing end surfaces; and interlock mechanisms on at least one of 1) the top and bottom surfaces, 2) the opposing side surfaces and 3) the opposing end surfaces. Because of the interlock mechanisms, a plurality of the containers may be stacked and shipped, such as on a pallet, without the use of support bands.

15 Claims, 8 Drawing Sheets

BAND-FREE CONTAINER PACKAGING

STATEMENT OF GOVERNMENT INTEREST

The inventions described herein may be manufactured, used and licensed by or for the U.S. Government for U.S. Government purposes.

BACKGROUND OF THE INVENTION

The invention relates in general to packaging and in particular to the stacking of containers.

Containers are often stacked on pallets for shipping. After the pallet is completely loaded with containers, the containers are typically secured to the pallet with bands or straps. When stacking the containers on the pallet, care must be taken to prevent the stacked containers from shifting or falling over. To unload the containers from the pallet, the bands are cut and the containers removed. Because of movement of the containers during shipping, sometimes the containers will undesirably "unstack" themselves when the bands are removed. Particularly for fragile containers or fragile container contents, even a short fall to the ground may cause damage.

Another problem with packaging bands occurs when only a portion of a pallet of containers is desired at a location. After the desired number of containers are removed from the pallet, the containers remaining on the pallet must be restacked and re-banded for shipping. There is a need for a packaging solution that overcomes the problems associated with banding containers together.

SUMMARY OF THE INVENTION

It is an object of the invention to provide interlocking containers.

It is another object of the invention to provide interlocking containers that may be stacked and shipped without using conventional bands.

One aspect of the invention is a container comprising top and bottom surfaces; opposing side surfaces; opposing end surfaces; and interlock mechanisms on at least one of 1) the top and bottom surfaces, 2) the opposing side surfaces and 3) the opposing end surfaces.

In one embodiment, the interlock mechanisms comprise side to side interlock mechanisms comprising a right side interlock and a left side interlock, the right side interlock comprising a generally V-shaped angle having a first portion that extends out and away from a side surface and a second portion that extends upward and substantially parallel to the side surface, the left side interlock comprising a generally V-shaped angle having a first portion that extends out and away from an opposing side surface and a second portion that extends downward and substantially parallel to the opposing side surface.

In another embodiment, the interlock mechanisms comprise end to end interlock mechanisms comprising a knob on a rear end of the container and an opening in a plate on the front end of the container. The plate may comprise a component of a closure for the container. The opening in the plate may be generally V-shaped and open downwardly.

In a further embodiment of the invention, the interlock mechanisms comprise top to bottom interlock mechanisms comprising front and rear tabs on the top surface of the container and a bottom assembly attached to the bottom surface of the container. The bottom assembly may include a peripheral skirt comprising a front lip having a generally flat surface substantially parallel to the bottom surface of the container.

The front tab includes a generally flat surface substantially parallel to the top surface of the container.

The bottom assembly includes at a rear end thereof a slider assembly comprising a handle disposed on an exterior of the bottom assembly and a slider attached to the handle and slidable through a slot in the peripheral skirt. The slider assembly includes a spring for biasing the slider assembly towards an interior of the bottom assembly. The slider includes a striker and the rear tab includes a striker plate operable to latch against the striker.

Another aspect of the invention is a pallet having a plurality of top to bottom interlock mechanisms comprising front and rear tabs that are substantially the same as the front and rear tabs on the top surface of the containers. The front and rear tabs on the pallet interlock with the bottom assemblies of the bottom row of containers on the pallet.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The invention includes a band-free packaging apparatus and method. The apparatus comprises a container having features for interlocking it with another, similar container. While the container shown in the Figures is generally rectangular, the invention is not limited to the specific geometry of a rectangular container. The inventive container includes one or more of lateral interlocking features, forward/backward interlocking features and top/bottom interlocking features.

Figure 1:
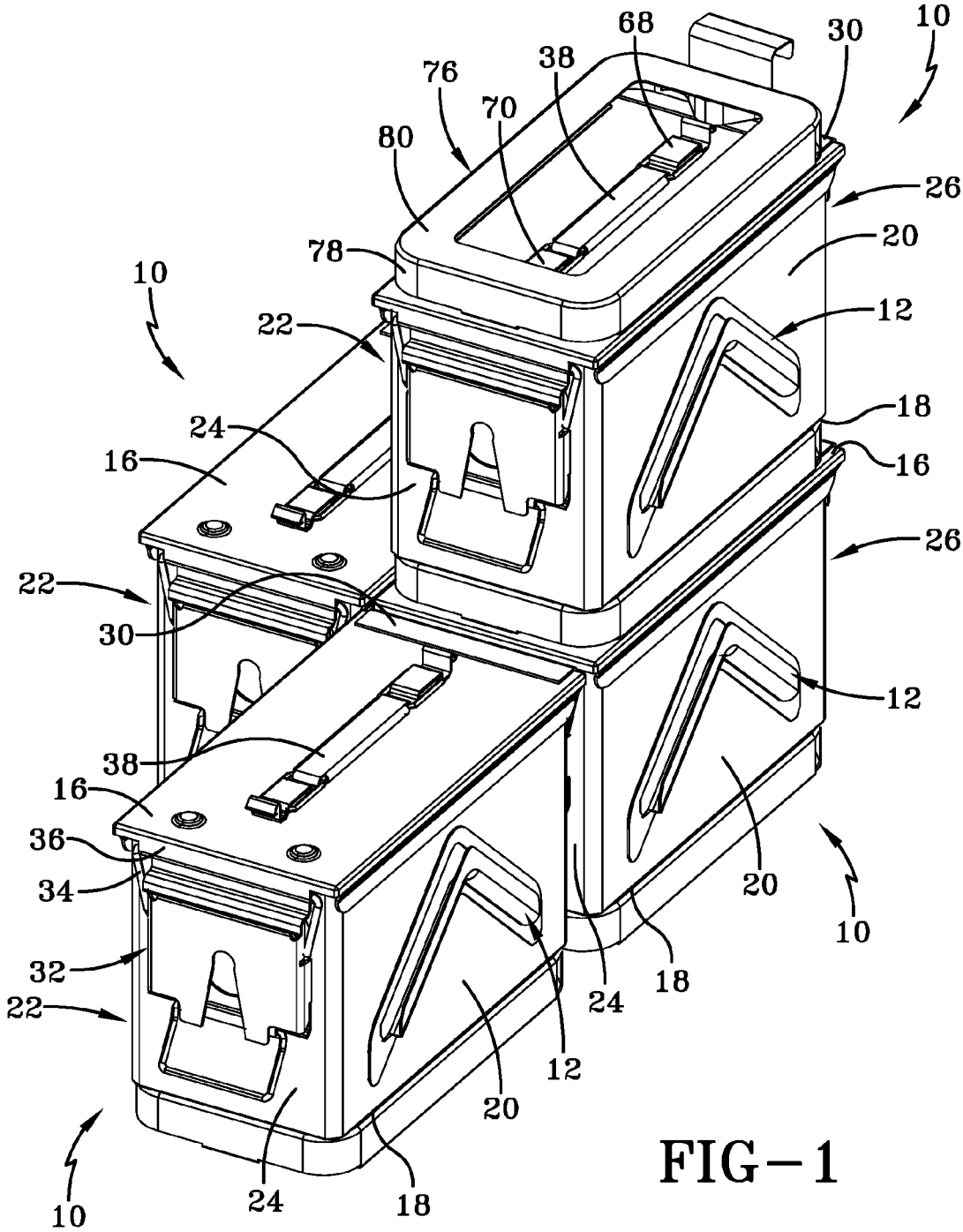
FIG. 1 is a perspective view of one embodiment of containers in accordance with the invention.
Figure 2:
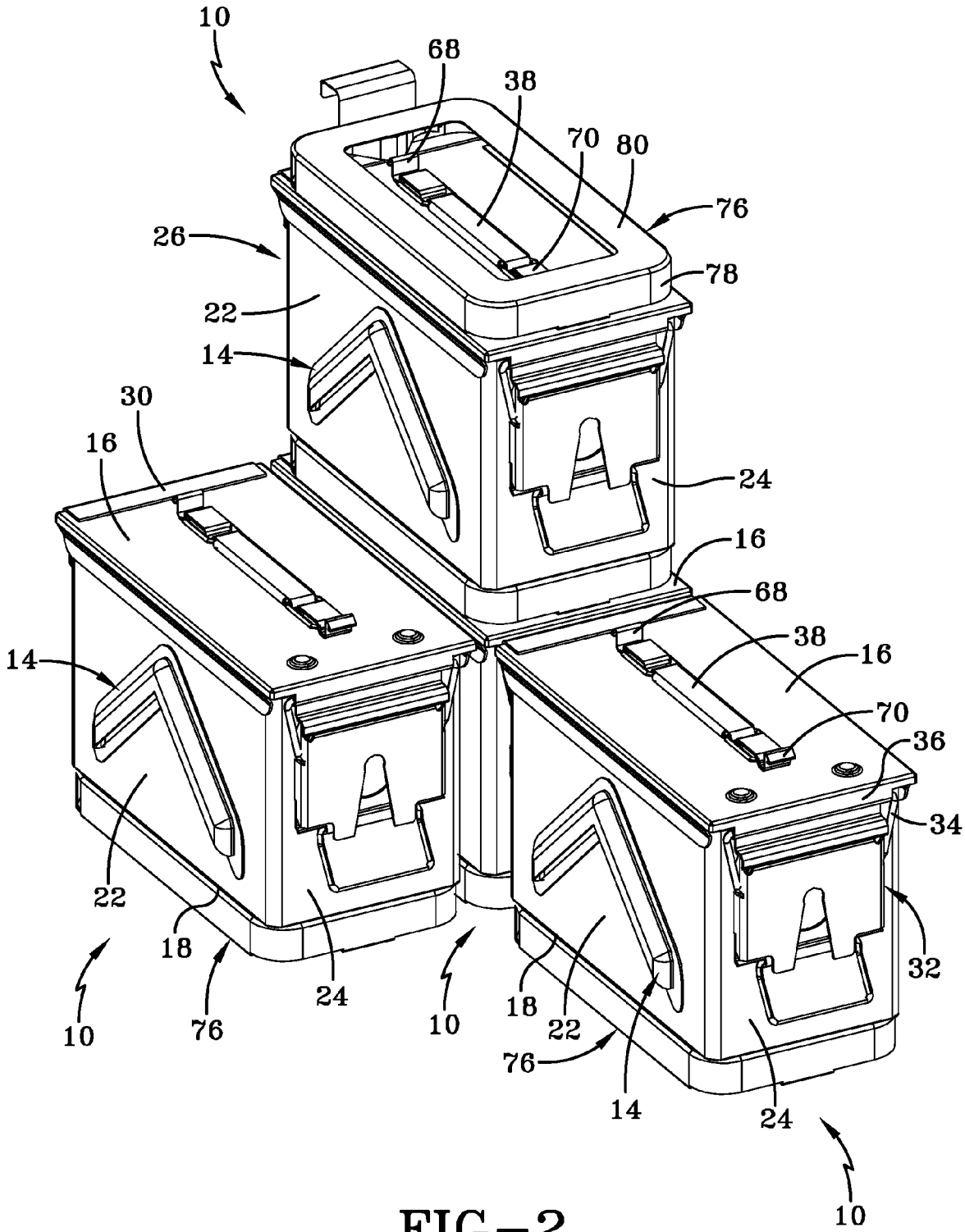
FIG. 2 is a perspective view of the containers of FIG. 1 taken from another angle.

FIG. 1 is a perspective view of one embodiment of containers 10 in accordance with the invention. FIG. 2 is a perspective view of the containers 10 of FIG. 1 taken from another angle. FIGS. 1 and 2 show five containers 10. Each container 10 comprises top and bottom surfaces 16, 18; opposing side surfaces 20, 22 and opposing end surfaces 24, 26. As viewed in FIG. 1, side surface 20 is the right side surface, side surface 22 is the left side surface, end surface 24 is the front end surface and end surface 26 is the rear end surface. The use of the terms right, left, front and rear is for clarity in describing the invention and is not meant to limit the location or orientation of the features of the invention.

Top surface 16 functions as a lid that is hinged at 30 to the rear surface 26 and held closed by closure 32 on front end 24. Closure 32 is known, particularly for military ammunition containers, and includes a wire or rod member 34 that fits in a rounded lip 36 attached to top surface 16. Top surface 16 includes a collapsible handle 38 thereon. The type of lid 36, lid closure 32 and handle 38 that are shown are exemplary only. Other types of lids, lid closures and handles may be used with container 10.

Figure 3:
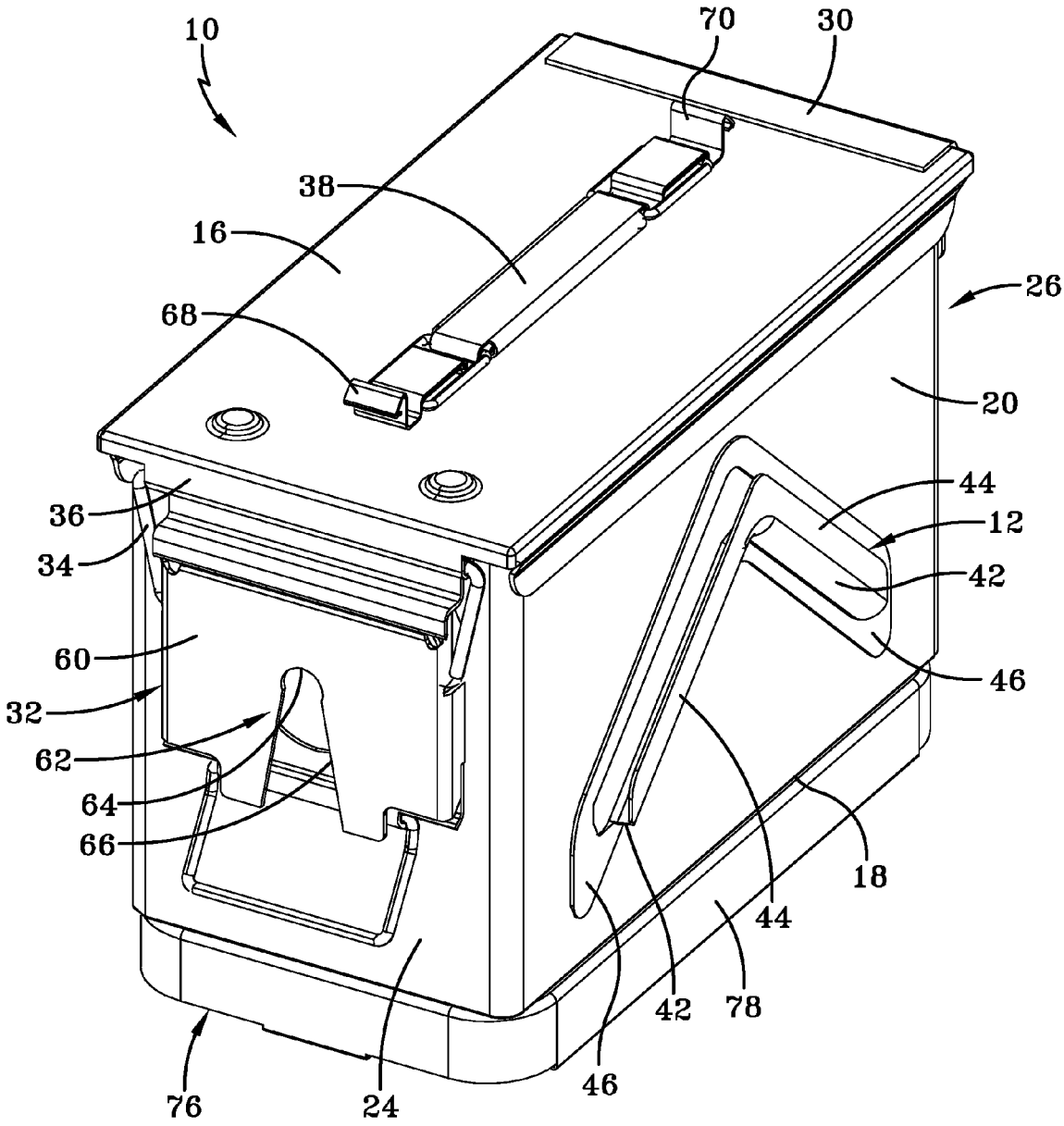
FIG. 3 is a perspective view of a container.
Figure 4:
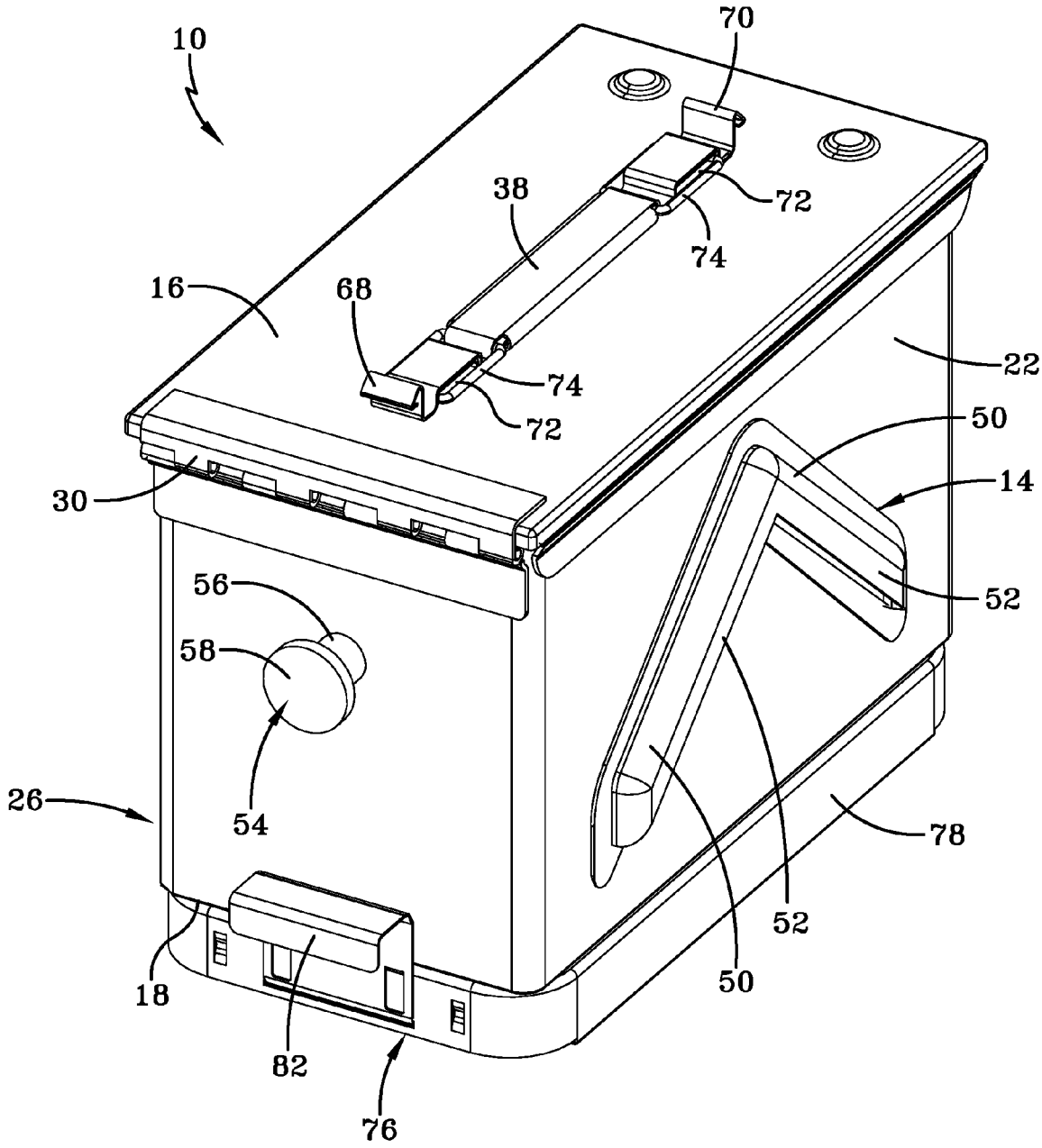
FIG. 4 is a perspective view of the container of FIG. 3 taken from another angle.

Right side 20 (FIG. 1) includes a side interlock 12 that mates with side interlock 14 on the left side 22 (FIG. 2) of an adjacent container. FIGS. 3 and 4 are perspective views of container 10 that show the side interlocks 12, 14. Interlock 12 comprises a generally V-shaped angle having a first portion 42 that extends out and away from side 20 and a second portion 44 that extends upward and substantially parallel to side 20. One way of making interlock 12 is to stamp and bend it from a piece of V-shaped flat stock. In that case, a base portion 46 may be attached to side 20 by, for example, welding. However, the edge of first portion 42 could be attached directly to side 20 without the need for base portion 46. Container 10 and its interlocks may comprise metal, plastics, or other suitable materials.

Left side 22 (FIG. 4) includes a side interlock 14 comprising a generally V-shaped angle having a first portion 50 that extends out and away from side 20 and a second portion 52 that extends downward and substantially parallel to side 20. Interlock 14 may be fabricated similarly to interlock 12. Interlocks 12, 14 work as follows. A first container 10 is placed in the position shown in FIG. 3. A second container 10 is positioned above and to the side of first container 10 such that interlock 14 of second container 10 is aligned with and vertically above interlock 12 of first container 10. As second container 10 is lowered, portion 44 of interlock 12 slides underneath portion 52 of interlock 14. Additional containers are interlocked in a similar manner. Any lateral forces on the containers will be resisted by the abutting surfaces of portions 44 and 52.

Referring again to FIGS. 3 and 4, container 10 has opposing front and rear end surfaces 24, 26. comprising end to end interlocking mechanisms. Front end 24 (FIG. 3) includes the closure 32 having a generally flat portion 60. Flat portion 60 includes an opening 62 comprising a circular portion 64 and a V-shaped portion 66. The V-shaped portion 66 opens towards the bottom of the container 10. Flat portion 60 and opening 62 comprise one of the end to end interlocks. Rear end 26 (FIG. 4) includes a knob 54 having a stem 56 attached to rear end 26 and a head 58 on the end of the stem 56. Knob 54 comprises the other end to end interlock. Ends of adjacent containers 10 are locked by sliding the stem 56 of knob 54 of one container 10 into the opening 62 in an adjacent container 10. Any end to end forces on the containers 10 will be resisted by the head 58 of knob 54 bearing against flat portion 60 of closure 32.

The top to bottom interlocking mechanisms are located on the top surface 16 and bottom surface 18 of container 10. As seen in FIG. 4, the top surface 16 includes upwardly projecting rear and front tabs 68, 70. When the container 10 includes a collapsible handle 38 as shown in FIG. 4, tabs 68, 70 may be conveniently fabricated to include loops 72. Loops 72 allow the rings 74 of handle 38 to move as the handle is raised and lowered. However, the loops 72 are not required for the top to bottom interlocking mechanism and may be omitted if another type of handle is used. The front and rear tabs 70, 68 comprise one portion of the top to bottom interlocking mechanisms.

The other portion of the top to bottom interlocking mechanism, as seen in FIG. 4, comprises a bottom assembly 76 attached to the bottom surface 18 of container 10. Bottom assembly 76 includes a peripheral skirt 78. Referring now to FIGS. 1 and 2, the topmost container 10 includes on its top surface a bottom assembly 76. Normally, bottom assembly 76 is attached to the bottom surface of a container 10 via the flat border surface 80. However, for clarity, only a bottom assembly 76 is shown on top of the topmost container in FIGS. 1 and 2. Inside of border surface 80, the bottom assembly 76 is open and the front and rear tabs 70, 68 of the container below are visible.

Figure 5:
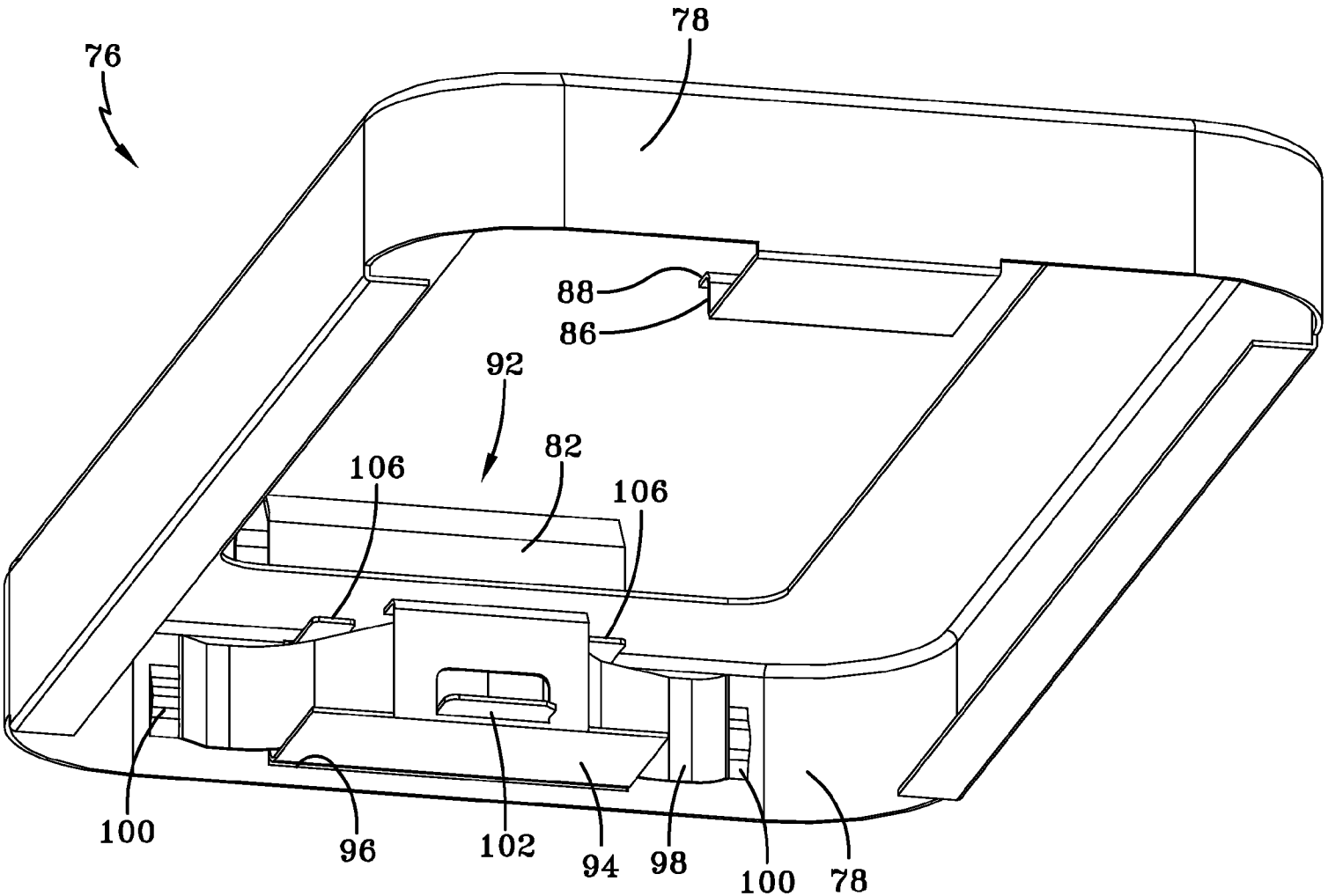
FIG. 5 is a perspective view of a bottom assembly.
Figure 6:
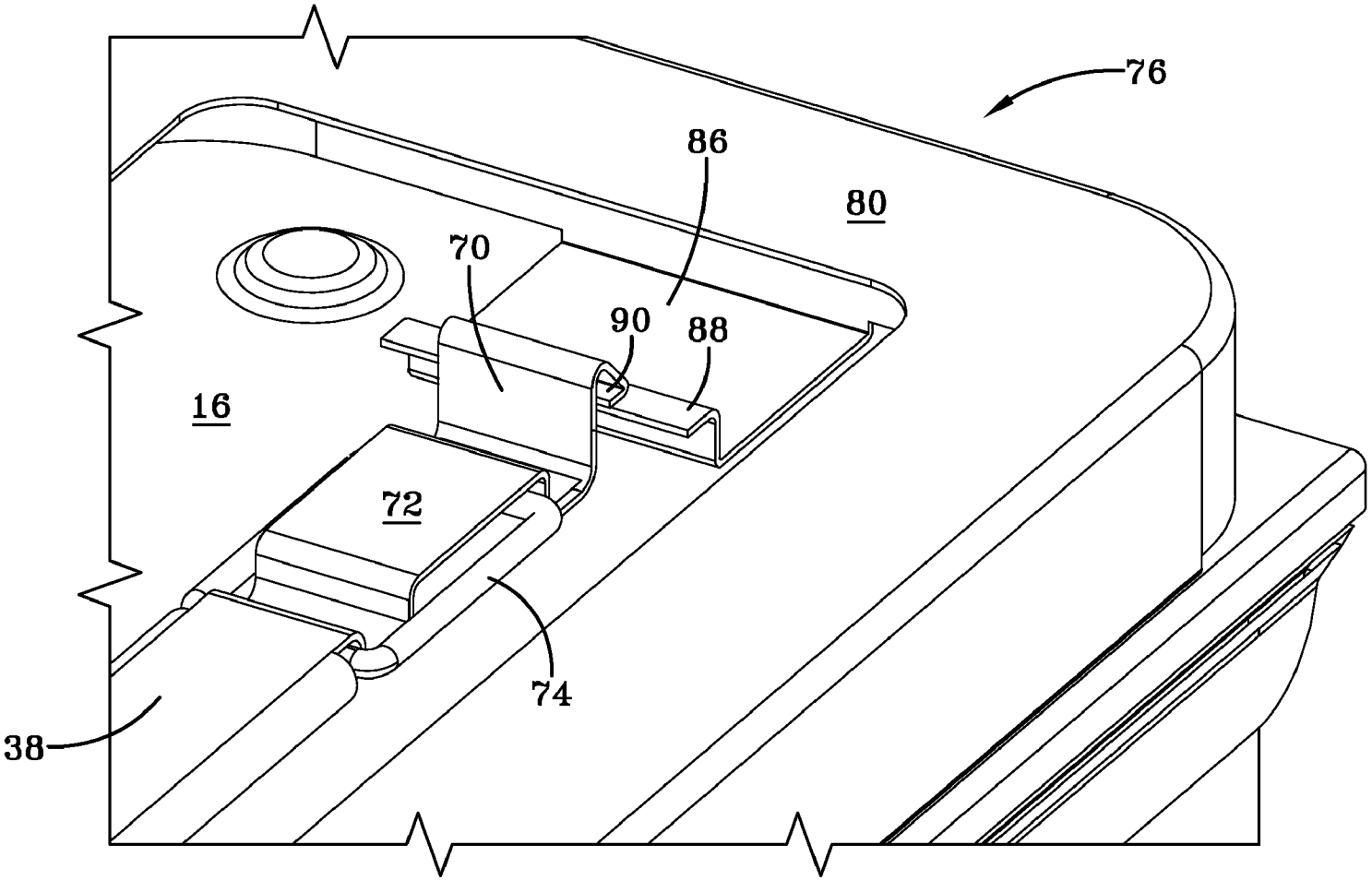
FIG. 6 shows one portion of the connection between the bottom assembly of one container and the top of another container.

FIG. 5 is a perspective view of a bottom assembly 76 having a front lip 86. Front lip 86 mates with front tab 70 (FIG. 4) on the top of another container. FIG. 6 shows the connection between the front lip 86 of one container (the top or upper container) and the front tab 70 of another container (the bottom or lower container). Front tab 70 includes a generally flat surface 90 substantially parallel to the top 16 of its container 10. Front lip 86 includes a generally flat surface 88 substantially parallel to the bottom (not shown in FIG. 6) of its container 10. When the front lip 86 of the upper container 10 is slipped under the front tab 70 of the lower container, the flat surfaces 88, 90 are adjacent each other and provide a bearing surface against forces tending to pull the upper container vertically away from the lower container.

Figure 7:
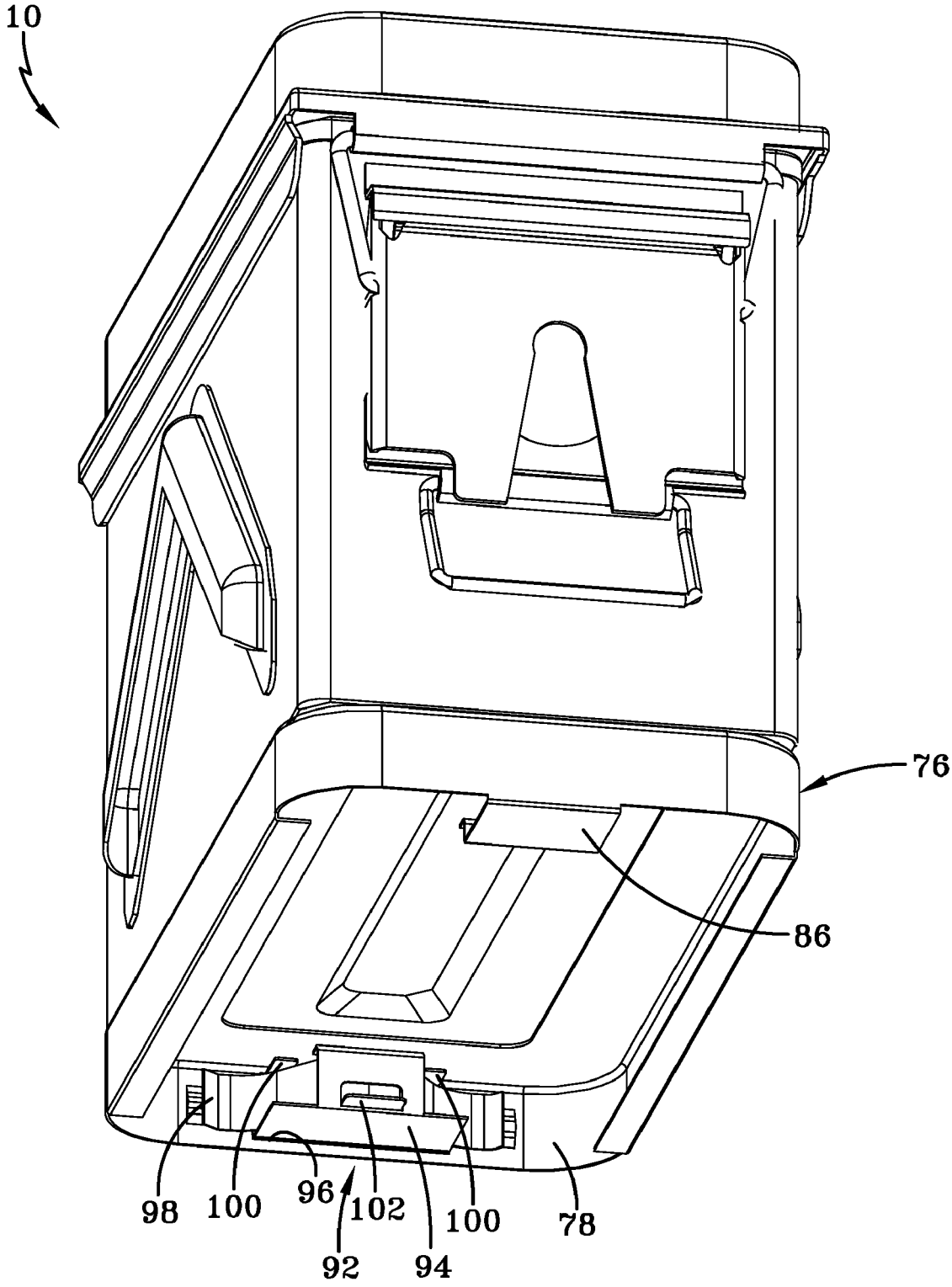
FIG. 7 is a perspective view of the bottom assembly attached to its container.
Figure 8:
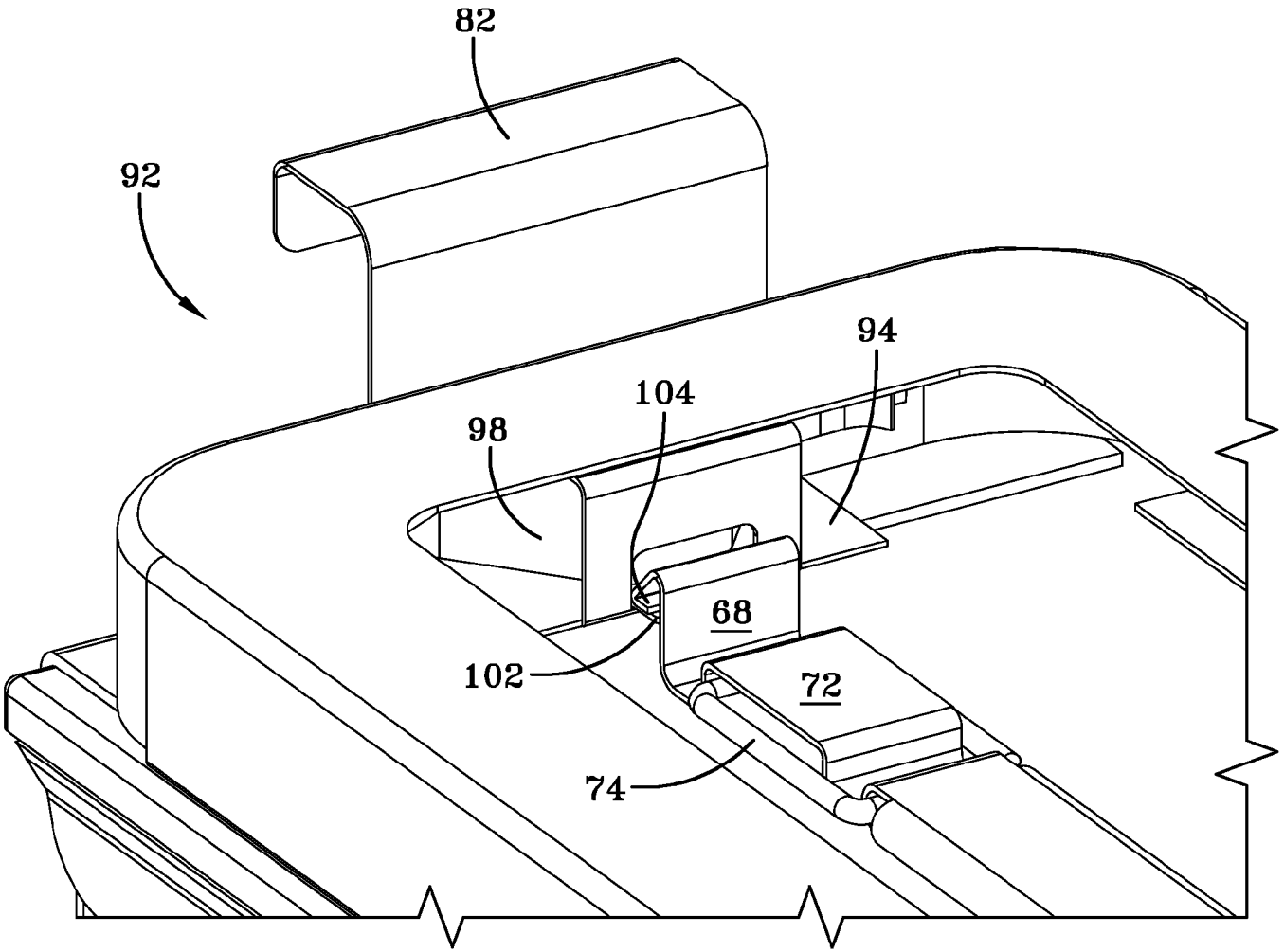
FIG. 8 is an enlarged view of another portion of the connection between the bottom assembly of one container and the top of another container.

FIG. 7 is a perspective view of the bottom assembly 76 of FIG. 5 attached to its container 10. FIG. 8 is an enlarged view of a portion of the connection between the bottom assembly 76 of one container and the top of another container. Referring to FIGS. 5, 7 and 8, the bottom assembly 76 includes at a rear end thereof a slider assembly 92 comprising a handle 82 (best seen in FIG. 4) disposed on an exterior of the bottom assembly 76 and a slider 94 attached to the handle 82 and slidable through a slot 96 in the peripheral skirt 78.

The slider assembly 92 further includes a spring 98 for biasing the slider assembly 92 towards an interior of the bottom assembly 76. A leaf-type spring 98 is shown in the Figs., but other types of springs may be used. The ends of spring 98 may be held in place with, for example, small protrusions 100 (FIG. 5) formed on the interior of the peripheral skirt 78. The sides of the spring are constrained by the slider 94 on one side and, for example, a pair of tabs 106 (FIGS. 5 and 7) attached to the interior of the peripheral skirt 78.

Slider 94 includes a striker 102 shown as a generally flat, horizontal surface. The rear tab 68 (FIG. 8) includes a striker plate 104 shown as a generally flat surface angled at about forty-five degrees with respect to the striker 102. In FIG. 8, the striker 102 is shown in a latched position beneath striker plate 104. The top to bottom interlocking mechanism operates as follows. Two containers 10 are initially separated. One container 10 is placed over and aligned with another container 10 with the upper container angled downward from its rear end 26 to its front end 24. The front lip 86 of the bottom assembly 76 of the upper container is guided below the front tab 70 of the lower container. The rear end 26 of the upper container is then lowered toward the lower container.

As the upper container is lowered, the striker 102 of the upper container will contact the striker plate 104 of the lower container. Further lowering of the upper container causes the striker 102 to move down the angled surface of the striker plate 104. The spring 98 keeps the striker 102 biased against the striker plate 104. When the striker 102 reaches the end of striker plate 104, the striker 102 is forced by spring 98 to slide under striker plate 104, thereby latching the upper container to the lower container. To unlatch the containers, one pulls on handle 82 to slide the striker 102 away from and free of striker plate 104. The upper container may then be lifted off the lower container. The spring-biased striker 102 and striker plate 104 operate much like a door latch, wherein the upper container is "snapped on" to the container below it.

A plurality of the containers 10 may be stacked and interlocked on a pallet. The integrity of the entire pallet (without the need for banding) is obtained by the interaction of neighboring containers 10 as a complete system. The top to bottom interlocking connection of an upper container to a lower container forces the lateral (side to side) and forward/backward (end to end) interlocking features to remain firmly engaged. In essence, each additional container 10 added to the stack locks down the container 10 that was last added to the stack. In some embodiments, a "build order" for the containers 10 may be necessary. In those embodiments, the unstacking of the containers 10 is the reverse of the build order.

A further feature of the invention is a pallet having interlock mechanisms that engage the bottom row of containers 10. The interlock mechanisms on the pallet may be similar to the upwardly projecting front and rear tabs 70, 68 located on the top surface of container 10 and shown in FIG. 4. A plurality of the tabs 70, 68 are positioned on and fixed to the pallet surface to interlock with the bottom assemblies 76 (FIGS. 5-8) of the bottom row of containers 10.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A container comprising:

top and bottom surfaces;

opposing side surfaces;

opposing end surfaces; and interlock mechanisms on at least one of 1) the top and bottom surfaces, 2) the opposing side surfaces and 3) the opposing end surfaces; and the interlock mechanisms comprise top to bottom interlock mechanisms comprising front and rear tabs on the top surface of the container and a bottom assembly attached to the bottom surface of the container; and the bottom assembly includes a peripheral skirt; and the bottom assembly includes at a rear end thereof a slider assembly comprising a handle disposed on an exterior of the bottom assembly and a slider attached to the handle and slidable through a slot in the peripheral skirt.

2. The container of claim 1 wherein the top and bottom surfaces include top to bottom interlock mechanisms.

3. The container of claim 1 wherein the opposing side surfaces include side to side interlock mechanisms.

4. The container of claim 1 wherein the opposing end surfaces include end to end interlock mechanisms.

5. The container of claim 2 wherein the opposing side surfaces include side to side interlock mechanisms.

6. The container of claim 5 wherein the opposing end surfaces include end to end interlock mechanisms.

7. The container of claim 3 wherein the opposing end surfaces include end to end interlock mechanisms.

8. The container of claim 1 wherein the interlock mechanisms comprise side to side interlock mechanisms comprising a right side interlock and a left side interlock, the right side interlock comprising a generally V-shaped angle having a first portion that extends out and away from a side surface and a second portion that extends upward and substantially parallel to the side surface, the left side interlock comprising a generally V-shaped angle having a first portion that extends out and away from an opposing side surface and a second portion that extends downward and substantially parallel to the opposing side surface.

9. The container of claim 1 wherein the interlock mechanisms comprise end to end interlock mechanisms comprising a knob on a rear end of the container and an opening in a plate on the front end of the container.

10. The container of claim 9 wherein the plate comprises a component of a closure for the container.

11. The container of claim 9 wherein the opening is generally V-shaped and opens downwardly.

12. The container of claim 11 wherein the knob includes a stem and a head.

13. The container of claim 1 wherein the peripheral skirt includes a front lip having a generally flat surface substantially parallel to the bottom surface of the container and the front tab includes a generally flat surface substantially parallel to the top surface of the container.

14. The container of claim 1 wherein the interlock mechanisms comprise top to bottom interlock mechanisms comprising front and rear tabs on the top surface of the container and a bottom assembly attached to the bottom surface of the container.

15. The container of claim 14 wherein the slider includes a striker and the rear tab includes a striker plate operable to latch against the striker.

* * * * *